US006378156B2

(12) United States Patent
Specht

(10) Patent No.: US 6,378,156 B2
(45) **Date of Patent: *Apr. 30, 2002**

(54) MOP, MOP ELEMENT AND MOP ELEMENT ASSEMBLY

(75) Inventor: Paul B. Specht, Wilmette, IL (US)

(73) Assignee: Freudenberg Household Products, River Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/809,238

(22) Filed: Mar. 15, 2001

Related U.S. Application Data

(63) Continuation of application No. 09/610,043, filed on Jul. 5, 2000, now Pat. No. 6,240,589, which is a continuation of application No. 09/112,624, filed on Jul. 9, 1998, now Pat. No. 6,112,358, which is a continuation of application No. PCT/US97/00472, filed on Jan. 10, 1997, which is a continuation-in-part of application No. 08/583,952, filed on Jan. 11, 1996, now abandoned.

(51) Int. Cl.[7] ..... A47L 13/12

(52) U.S. Cl. ..... 15/120.2; 15/120.1; 15/229.1; 15/228

(58) Field of Search ..... 15/120.1, 120.2, 15/119.1, 228, 229.1, 229.2, 229.6, 116.1

(56) References Cited

U.S. PATENT DOCUMENTS

| | | | | | |
|---|---|---|---|---|---|
| 429,835 | A | * | 6/1890 | Bateman | 15/120.2 |
| 739,786 | A | * | 9/1903 | Lay | 15/229.1 |
| 780,945 | A | * | 1/1905 | Fenton | 15/147.1 |
| 973,491 | A | * | 10/1910 | Fisher, Jr. | 15/120.2 |
| 1,126,887 | A | * | 2/1915 | Scott | 15/120.2 |
| RE15,274 | E | * | 1/1922 | Kenner | 15/120.2 |
| 1,475,083 | A | * | 11/1923 | Portner | 15/120.2 |
| 1,494,871 | A | * | 5/1924 | Watkins et al. | 15/120.2 |
| 1,514,051 | A | * | 11/1924 | Jumonville | 15/120.2 |
| 1,520,500 | A | * | 12/1924 | Jumonville | 15/120.2 |
| 1,567,519 | A | * | 12/1925 | Leclerc et al. | 15/120.2 |
| 1,924,817 | A | * | 8/1933 | Tatter | 15/120.2 |
| 1,937,141 | A | * | 11/1933 | Carlson | 15/120.1 |
| 2,042,892 | A | * | 6/1936 | Gronger | 15/120.2 |

(List continued on next page.)

FOREIGN PATENT DOCUMENTS

| | | | | |
|---|---|---|---|---|
| CA | 767342 | | 9/1967 | |
| DE | 25 51 678 A1 | | 6/1977 | |
| DE | 26 11 615 A1 | | 9/1977 | |
| DE | 196 13 882 A1 | | 11/1996 | |
| DE | 196 45 927 A1 | | 5/1998 | |
| GB | 104093 | * | 2/1917 | 15/120.1 |
| GB | 932579 | | 7/1963 | |
| GB | 1300709 | * | 12/1972 | 15/120.1 |
| WO | WO 95/07046 | * | 3/1995 | 15/120.1 |

*Primary Examiner*—Gary K. Graham
(74) *Attorney, Agent, or Firm*—Leydig, Voit & Mayer LTD

(57) ABSTRACT

Disclosed is a mop having an elongate shaft, a mop element, and an operating member that is axially movable along a portion of the shaft between a range of mopping positions and a latch position. One end portion of the mop element is retained in a fixed position at one end of the shaft, the other end portion of the mop element is retained at one end of the operating member with an intermediate mopping portion formed into a bight. In accordance with the invention, the mop includes a latch mechanism for axially retaining the operating member in the latch position. The latch mechanism includes a detent portion and a shoulder portion. One portion is fixedly mounted to the shaft and the other is mounted on the operating member. Preferably, the mop is a twist mop wherein the operating member is relatively rotatable with respect to the shaft. More preferably, the mop includes a ratchet mechanism for releasably restricting relative rotation of the operating member and shaft to one direction of rotation.

6 Claims, 6 Drawing Sheets

U.S. PATENT DOCUMENTS

| | | | | | |
|---|---|---|---|---|---|
| 2,059,773 | A | * | 11/1936 | Buell | 15/120.2 |
| 2,185,502 | A | * | 1/1940 | Fatland | 15/120.2 |
| 2,230,101 | A | * | 1/1941 | Bakemeier | 15/120.2 |
| 2,495,846 | A | * | 1/1950 | Johnson | 15/120.1 |
| 2,740,146 | A | | 4/1956 | Vaughn | |
| 2,835,914 | A | * | 5/1958 | Littleton | 15/229.1 |
| 2,852,794 | A | | 9/1958 | Blum | |
| 3,150,400 | A | * | 9/1964 | Fungaroli | 15/120.2 |
| 3,278,977 | A | * | 10/1966 | Makar | 15/120.2 |
| 3,334,369 | A | * | 8/1967 | Makar | 15/120.2 |
| 3,669,603 | A | * | 6/1972 | Keller et al. | 425/326 |
| 4,130,910 | A | * | 12/1978 | Raven | 15/120.1 |
| 4,178,650 | A | * | 12/1979 | Aasland | 15/120.2 |
| 4,479,278 | A | * | 10/1984 | Heinonen | 15/120.2 |
| 4,717,616 | A | | 1/1988 | Harmon et al. | |
| 4,790,603 | A | | 12/1988 | Harmon et al. | |
| 4,790,604 | A | | 12/1988 | Harmon et al. | |
| 5,042,105 | A | | 8/1991 | Buck et al. | |
| 5,131,111 | A | | 7/1992 | Richardson et al. | |
| 5,509,163 | A | * | 4/1996 | Morad | 15/120.2 |
| 5,538,327 | A | * | 7/1996 | Martorella et al. | 300/21 |
| 5,615,442 | A | * | 4/1997 | Schroeck et al. | 15/147 |
| D384,458 | S | * | 9/1997 | Schroeck et al. | D32/51 |
| 5,850,658 | A | * | 12/1998 | Specht | 15/120.1 |
| 6,260,226 | B1 | | 7/2001 | Specht | |

* cited by examiner

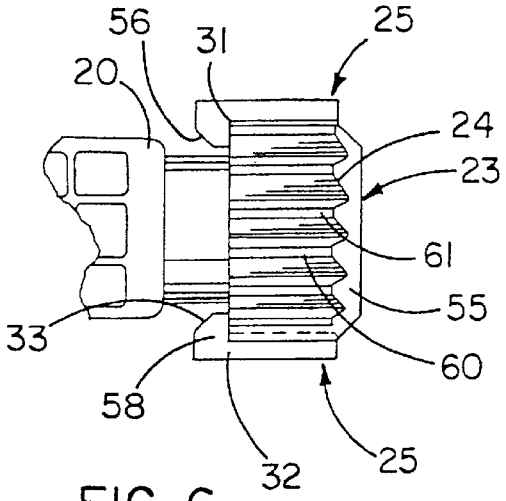
FIG. 6
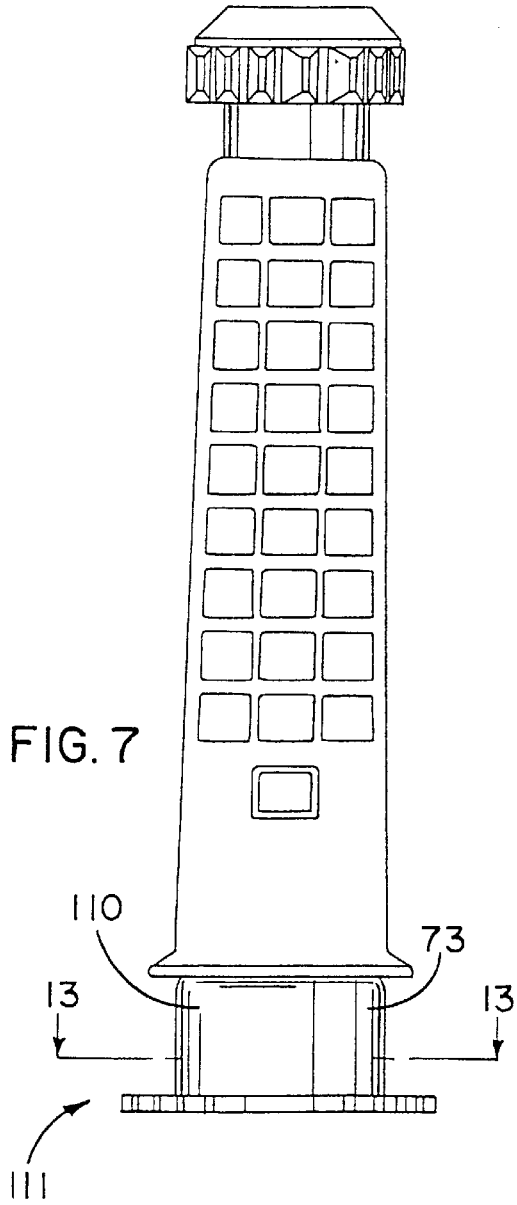
FIG. 7
FIG. 9
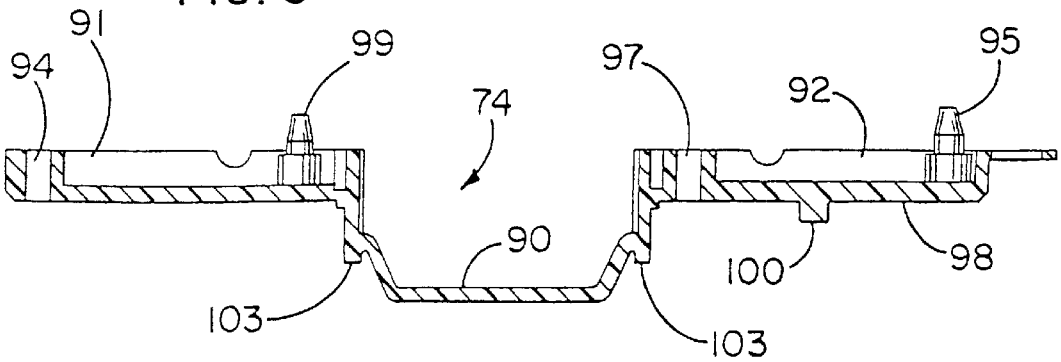

MOP, MOP ELEMENT AND MOP ELEMENT ASSEMBLY

This application is a continuation of U.S. patent application Ser. No. 09/610,043, filed Jul. 5, 2000, now U.S. Pat. No. 6,240,589; which application was a continuation of Ser. No. 09/112,624, filed Jul. 9, 1998, now U.S. Pat. No. 6,112,358; which application was a continuation of International Patent Application No. PCT/US97/00472, filed Jan. 10, 1997, which designated the United States; which application was a continuation-in-part of U.S. patent application Ser. No. 08/583,952, filed Jan. 11, 1996, now abandoned. All prior applications are hereby incorporated by reference in their entireties.

TECHNICAL FIELD OF THE INVENTION

The invention relates in general to mops. More particularly, the invention pertains to mops having a shaft, a mop element, and an operating member that supports a portion of the mop element and that is movable with respect to the shaft.

BACKGROUND OF THE INVENTION

Conventional mops include an elongate shaft having a mop element at one end of the shaft and an operator gripping portion at the other end of the shaft. In some commercially available mops, the mop element may be twisted around the shaft to thereby wring from the mop element the liquid which has been absorbed during use of the mop. Such mops are known in the art as "twist mops."

One problem associated with prior art twist mops is that a considerable amount of strength is required to hold the mop parts in a wringing position and to apply the force necessary to expel the absorbed liquid from the mop element. This is particularly true when the mop element must be twisted through a large overall angle of rotation. The prior art has addressed this problem by utilizing a mop element having relatively short liquid-absorbing ropes in an effort to reduce the overall angle of rotation. However, the use of such relatively short strands results in the mop element having a relatively small surface area. This is undesirable, inasmuch as the area of contact between the mop element and the surface to be mopped is thereby reduced.

It is a general object of the invention to provide a mop that overcomes the shortfalls inherent in prior art mops. Another object of the invention is to provide a twist mop having an operating member that may be advanced for wringing in small angular increments.

SUMMARY OF THE INVENTION

The invention provides a mop having an elongate shaft, a mop element, and an operating member that is axially movable along a portion of the shaft over a range of travel between and a latch position and a range of mopping positions. One portion of the mop element is retained in a fixed position at one end of the shaft, and another portion of the mop element is retained at one end of the operating member. In accordance with the invention, the mop includes a latch mechanism for axially retaining the operating member in the latch position. The latch mechanism includes a detent portion and a shoulder portion, one of which portions is fixedly mounted to the shaft and the other of which is mounted on the operating member. In accordance with the preferred embodiment of the invention, the detent portion of the latch mechanism comprises a pair of opposing jaws, which are fixed with respect to the shaft. In this embodiment, the shoulder portion is mounted at one end of the operating member. The operating member is retained in the latch position when the shoulder and detent are in an operative relationship.

Preferably, the operating member is relatively rotatable with respect to the shaft. The portion of the mop element that is retained at the operating member will be carried with the operating member, and thus will rotate with respect to the shaft when the operating member is rotated. Thus, upon twisting of the operating member, the mop element will twist with respect to the shaft, and wringing of the mop element will be effected thereby. Most preferably, the mop includes a ratchet device to releasably restrict relative rotation of the shaft and operating member to one direction of rotation. In accordance with one embodiment of the invention, a ratchet wheel is disposed at the shoulder of the operating member and the detent has two jaws. At least one of the jaws of the detent portion includes a multitoothed pawl for engaging a portion of the ratchet wheel to thereby permit only unidirectional rotation of the operating member relative to the mop shaft. In this embodiment, advancement of the operating member in limited angular increments relative to the shaft is thereby permitted.

In a highly preferred embodiment of the invention, a mop element assembly including the mop element and one or more button operable connectors is provided. For example, one end of the mop element may be supported by a button operable shaft connector that is releasably connectable to and supported by the shaft. Another end of the mop element may be supported by a button operable operating member connector that is releasably connectable to and supported by the operating member. When it is desired to clean or replace the mop element, the button operable connectors may be quickly released to thereby allow disassembly of the mop element from the shaft and from the operating member. The button operable connectors also allow the mop to be quickly reassembled after cleaning or replacement of the mop element assembly. A mop, a mop element assembly each being new and unobvious and methods of forming and operating mop apparatus, fall within the scope of the present specification.

DESCRIPTION OF THE DRAWINGS

FIG. 6 is a side elevational view of the latch mechanism shown in FIG. 5.

FIG. 7 is a side elevational view of the operating member, including the operating member connector, of the mop shown in FIGS. 1 and 2.

FIG. 9 is a cross-sectional view of the shaft connector illustrated in the mop shown in FIG. 8, shown prior to the assembly of the connector with the mop element and the shaft of the mop.

DESCRIPTION OF THE PREFERRED EMBODIMENT

Figure 1:
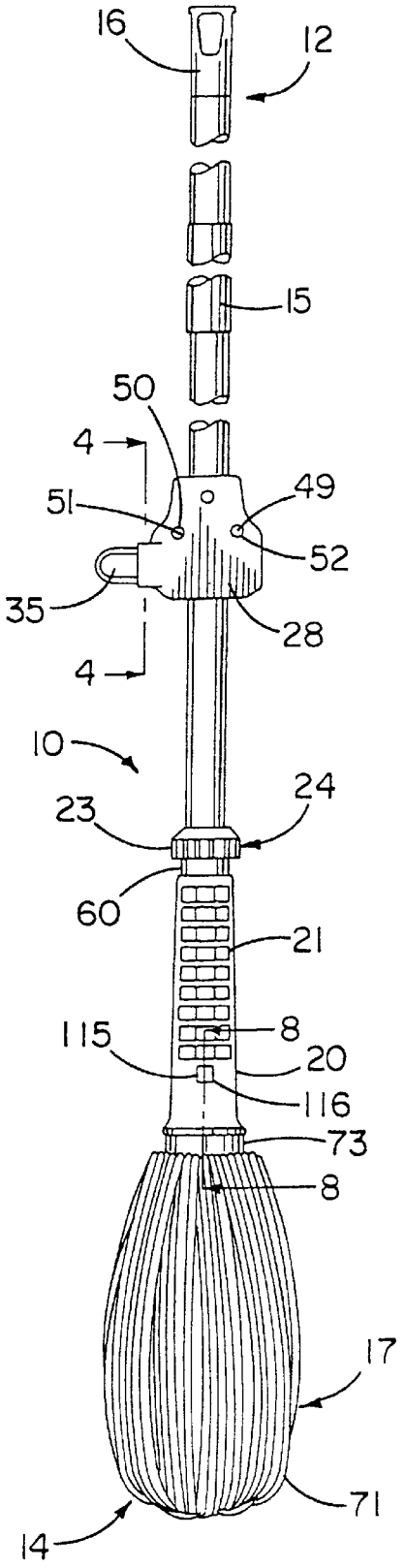
FIG. 1 is an elevational view of a twist mop in accordance with one embodiment of the invention, illustrating the tubular operating member in a fully extended mopping position.
Figure 2:
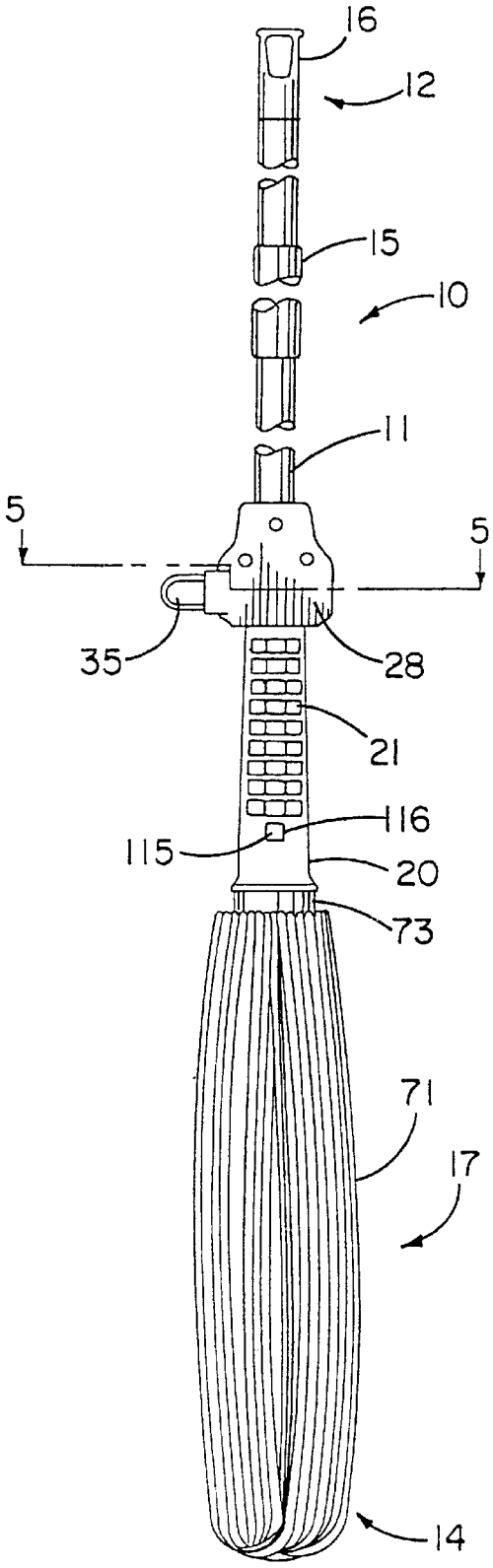
FIG. 2 is an elevational view of the twist mop shown in FIG. 1, illustrating the tubular operating member in the latch position.

The preferred embodiment of the invention is a twist mop. With reference to FIGS. 1 and 2, the twist mop 10 includes an elongate shaft 11 having an operator end 12 and a mop element end 14. A hand grip 15 is disposed near the operating end 12 of the shaft, and a hanging loop 16 is disposed at the operator end 12. The twist mop 10 further includes a mop element 17, a portion of which is attached to the mop element end 14 of the shaft 11. (See FIG. 14).

In accordance with the invention, another portion of the mop element 17 is connected to an operating member 20, which is axially movable with respect to the shaft 11. Preferably, the operating member 20 is axially movable between a range of mopping positions, one of which is illustrated in FIG. 1, and a latch position, as illustrated in FIG. 2. The operating member 20 has a hand grip surface 21 to permit a user to adjust the axial position of the operating member 20.

In accordance with the invention, the twist mop 10 includes a latch mechanism for retaining the operating member 20 in the latch position. Preferably, the latch mechanism comprises a shoulder portion, or shoulder 24 and a detent portion 25 within housing 28 (See FIGS. 3–6). With reference to FIGS. 1 and 6, the shoulder 24 is disposed on the operator end 23 of the operating member 20. The shoulder 24 preferably is integral with the operating member 20, and includes a central bore through which passes the shaft 11.

Figure 4:
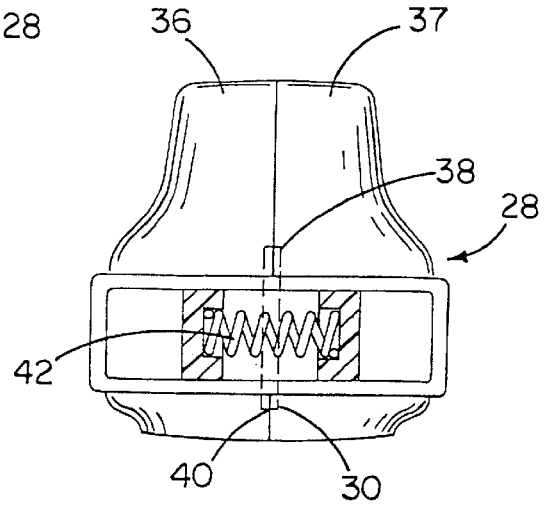
FIG. 4 is a side elevational, partially cut away view of the detent portion of the latch mechanism of the mop shown in FIGS. 1 and 2, taken along line 4—4 of FIG. 1.
Figure 5A:
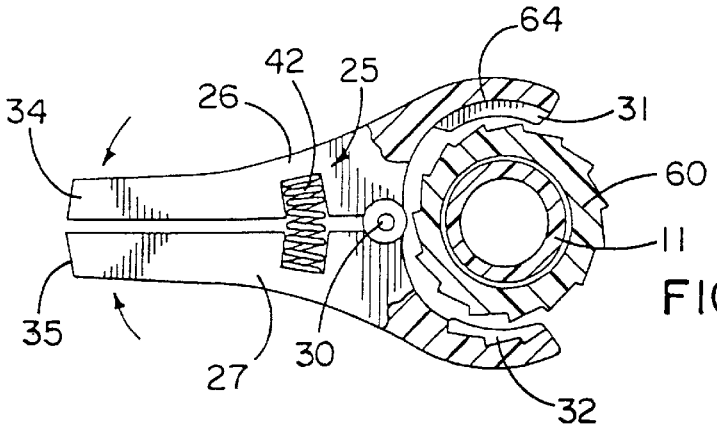
FIG. 5A is like FIG. 5, but shows the latch mechanism in the unlatched position.
Figure 5:
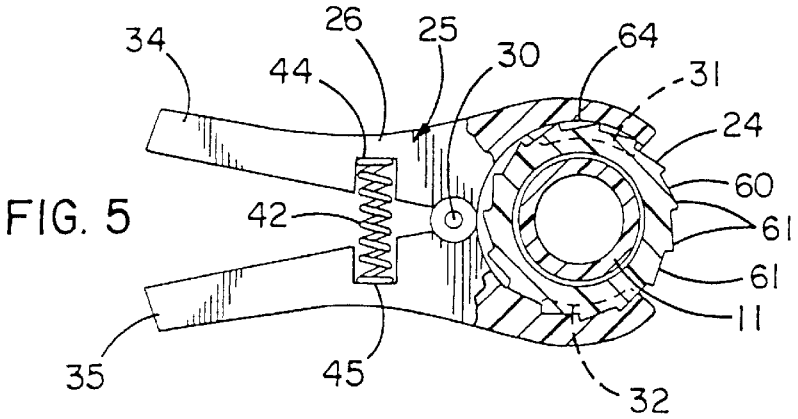
FIG. 5 is a partially plan, partially cross-sectional view taken along line 5—5 in FIG. 2, illustrating the latch mechanism of the mop shown in FIGS. 1 and 2.

As best shown in FIG. 5, the detent portion 25 comprises portions of a pair of opposing caliper jaws 26, 27 which are pivotally connected to one another and to a housing 28 and 4 by a pivot rod 30. (shown in FIGS. 1 and 2) Preferably, as shown in FIGS. 5 and 6, the jaws 26, 27 include a detent 31, 32 respectively for engaging the shoulder 24 when the operating member 20 is in the latch position. As shown in FIG. 5A respective end portions of the jaws 26, 27 form tabs 34, 35, which are adapted to be manually squeezed together to release the shoulder 24 from engagement within the detent portion 25. As shown in FIGS. 4 and 5, the pivot rod 30 is secured to the housing 28 between mating housing elements 36, 37 with portions of the rod 30 extending into blind holes 38, 40 formed in the housing elements 36, 37. The jaws are spring-loaded into the retaining position shown in FIG. 5 by a resilient coil spring 42 which is compressed between the ends of a pair of opposing blind holes 44, 45 in the jaws 26, 32.

Figure 3:
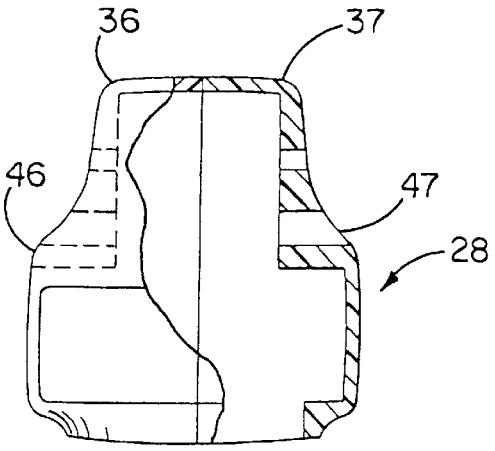
FIG. 3 is an elevational, partially cut away view of the housing of the detent portion of the latch mechanism of the mop shown in FIGS. 1 and 2.

The housing preferably is affixed to the shaft 11 between the ends of the shaft 11. As best shown in FIG. 3, the housing elements 36, 37 include aligned, centrally located holes 46, 47 therein to receive a fastening rivet (not shown in FIG. 3), which extends through the holes and through a corresponding bore in the shaft 11. As illustrated in FIG. 1, the housing elements preferably further include aligned openings 49, 50 for receiving a pair of fastening rivets 51, 52 to connect the housing elements to one another.

The shoulder 24 terminates at a frustoconical ramp surface 55. As shown in FIG. 6, the terminal surfaces of the detents 31, 32 are tapered inwardly to provide ramp surfaces 56, 58. When the operating member 20 is brought to bear against the detents 31, 32 the frustoconical ramp surface 55 engages the ramp surfaces 56, 58 to thereby spread the jaws 26, 27 as shown in FIG. 5A and to admit the shoulder 24. After the shoulder 24 has passed beyond the detents 31, 32 the spring-biased jaws 26, 27 return to the retaining position shown in FIGS. 5 and 6. Thus, the operating member 20 will be retained axially in the latch position by the latch mechanism. To release the operating member 20, the twist mop 10 is held with the operator end above the mop element end, as shown in FIGS. 1 and 2. The tabs 34, 35 may then be squeezed together to thereby release the latch mechanism. The operating member 20 and associated portion of the mop element 17 will be permitted to drop to a mopping position under the force of gravity or with operator assistance.

In accordance with a preferred embodiment of the invention, the shaft has a circular cross-section, and the operating member is tubular and rotatable with respect to the shaft. More preferably, the twist mop includes a ratchet device for releasably restricting relative rotation of the shaft and operating member. The ratchet device comprises a ratchet wheel and a pawl, one of which is disposed on the operating member and one of which is disposed on the shaft. As shown in FIGS. 1, 2, and 5, the ratchet device of the preferred embodiment of the invention comprises a ratchet wheel and a pawl, one of which is disposed on the shaft 11 and one of which is disposed on the operating member 20. Preferably, the ratchet wheel 60 is disposed on a portion of the shoulder 24 of the operating member 20, as shown, for example, in FIGS. 1, 5, and 6. The ratchet includes a plurality of ratchet teeth 61. As shown in FIG. 5, a multi-toothed pawl 62 is provided on at least one of the jaws 26 of the detent portion 25 of the latch mechanism. Preferably, the inner surface 64 of the other jaw is smooth. In this embodiment of the invention, the ratchet wheel 60 engages the pawl 62 of the jaw 26 when the operating member 20 is in the latch position, as shown in FIG. 5. The operating member 20 may then be rotated only in one direction of rotation, and will not be susceptible to torsional forces generated within the mop element that would urge rotation in the opposite direction. The operating member 20 thus may be rotated in small angular increments and released between increments, thereby allowing facile wringing of the mop element.

The mop element may comprise any wringable liquid absorbing material. For example, the mop element may comprise a plurality of liquid absorbent fiber ropes (sometimes referred to as "strings"), or may comprise a plurality of absorbent material strips. In accordance with the preferred embodiment of the invention, as illustrated in FIG.

2A, the mop element 17 has a first end 66 supported by the operating member 20, a second end 67 supported by the shaft 11, and an elongate intermediate portion 68. The intermediate portion 68 includes a plurality of ropes 70 of sufficient length to define a bight 71 that extends from the first end 66 and terminates in a reentrant portion at the second end 67. When the twist mop 10 is in a mopping position, such as, for example, the position shown in FIG. 1, the bight 71 comprises a mopping portion.

Figure 14:
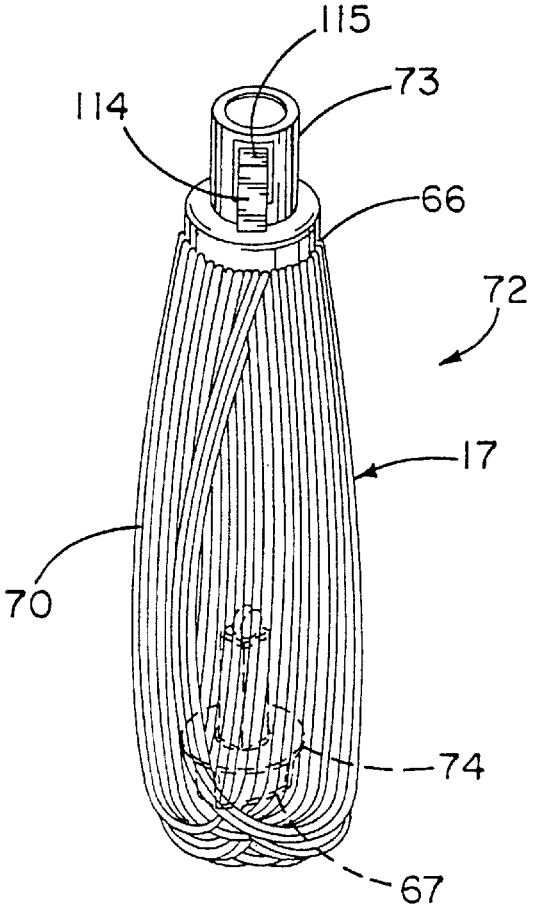
FIG. 14 is a perspective view of the mop element assembly of the invention with the shaft connector 14 shown in broken lines.

Preferably, as shown in FIG. 14, a mop element assembly 72 comprises the mop element 17 and one or both of an operating member connector 73 and a shaft connector 74 (shown in phantom lines in FIG. 14). Preferably, the first end 66 of the mop element 17 is secured to the operating member connector 73, and the second end 67 is secured to the shaft connector 74. The operating member connector 73 is releasably connectable to the operating member (not shown in FIG. 14), and the shaft connector 74 is releasably connectable to the shaft 11 (not shown in FIG. 14).

Figure 12:
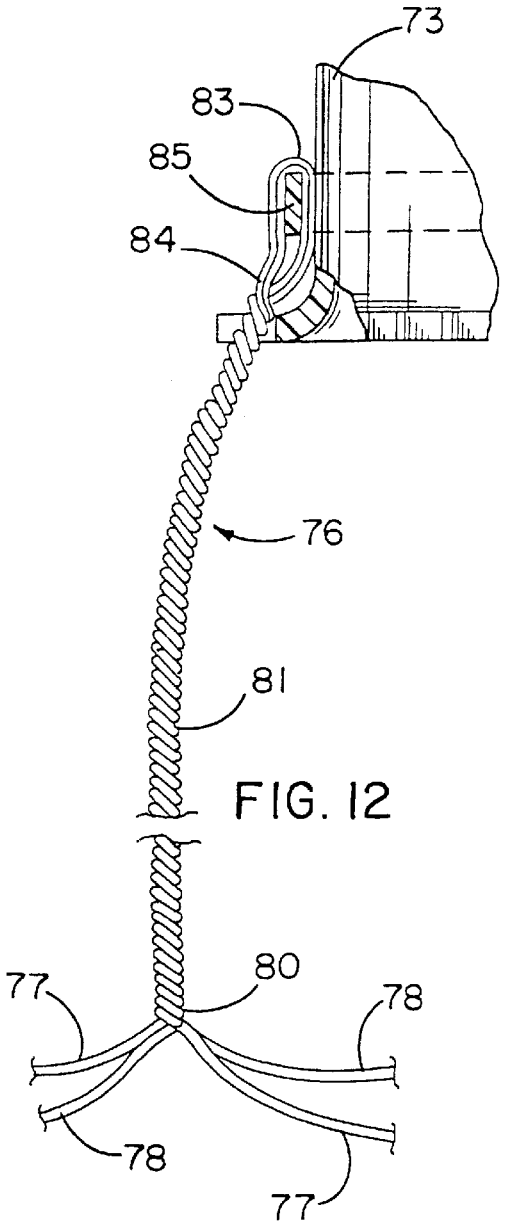
FIG. 12 is an enlarged fragmentary view of the operating member connector and the mop element.

Most preferably, the mop element 17 comprises an interconnected plurality of flexible ropes 70, each of which comprises an interwoven set of spun fibrous liquid absorbent strands. As shown in FIG. 12, a rope 76 comprises two pairs of strands 77, 78, each of which extends from a first end 80 of the rope 76, through an intermediate portion 81 of the rope 76 and to a loop 83 at a second end 84 of the rope 76. One pair of strands 77, 78 pass around a tie 85 to form the loop and then become the second of the pair of strands 77, 78. Returning from the loop, the strands 77, 78 further extend back through the intermediate portion 81 and to the first end 80 of the rope 76. The tie 85 secures the loop 83 to a portion of the mop 10, for example, a connector (shown in the illustrated embodiment as the operating member connector 73) at the second end of the rope. The strands then continue to form the other ropes of the mop element (not shown in FIG. 12). Further details about the mop element may be found in U.S. Pat. Nos. 4,717,616; 4,790,603; and 4,790,604 (Harmon et al.). Preferably, the first end 80 of the rope is disposed at and supported by the shaft connector 74 (not shown in FIG. 12), and the second end 84 having the loop 83 is disposed at and supported by the operating member connector 73; however, the ends may be interchanged if desired.

Figure 2A:
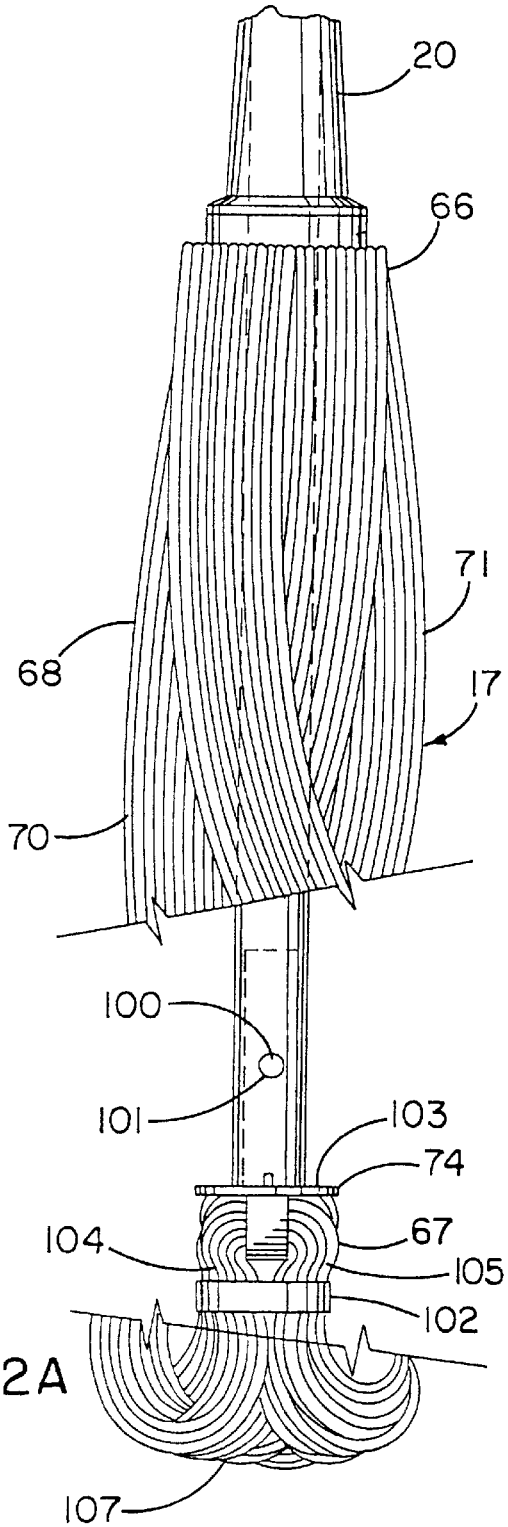
FIG. 2A is an elevational, partially cut away view of the twist mop shown in FIGS. 1 and 2 with the ropes spread to show the mechanism with clarity.
Figure 8:
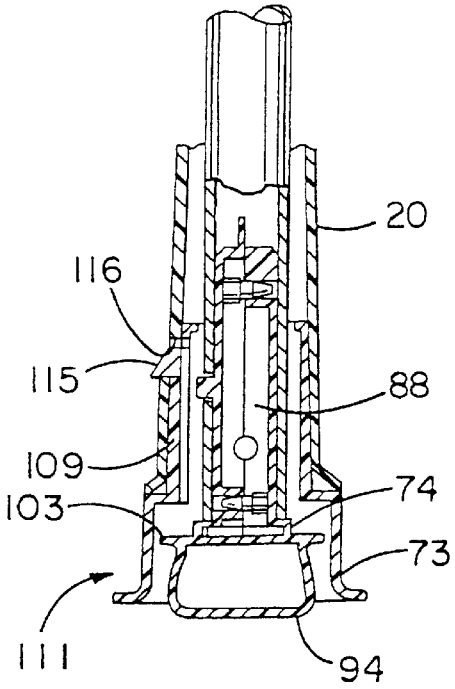
FIG. 8 is a partial sectional view of the mop shown in FIGS. 1 and 2 taken on the line 8—8 of FIG. 1.
Figure 10:
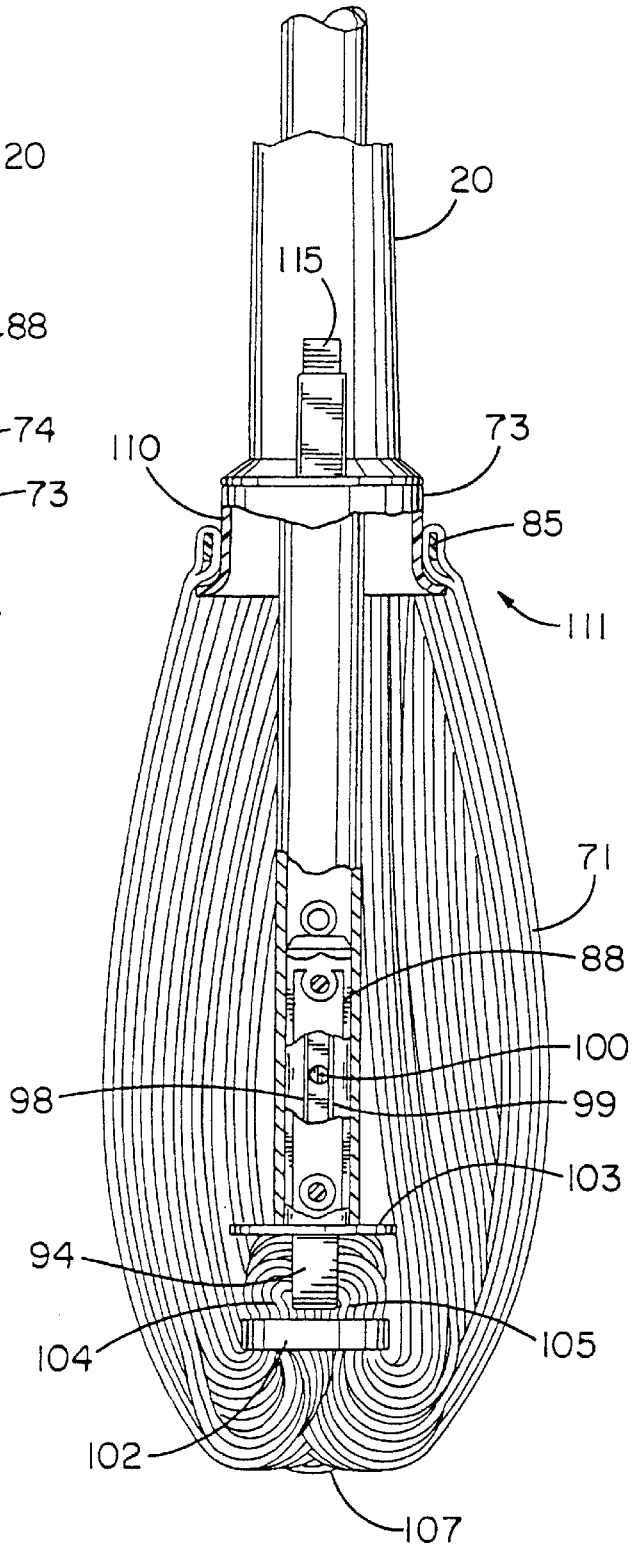
FIG. 10 is an elevational, partially cut away view of the mop as shown in FIG. 1.

FIGS. 8–10 illustrate the shaft connector 74. The shaft connector 74 comprises a unitary elongate body 88 having a flexible bight portion 90. As shown in FIG. 9, the body comprises a first end portion 91, a second end portion 92, and means for retaining the first and second end portions 91, 92 in a side-by-side relationship. When the end portions 91, 92 are so retained, the bight portion 90 forms a strap 94 for retaining a portion of the mop element 17, as shown in FIG. 10. Any suitable means for retaining the end positions 91, 92 in a side-by-side relationship may be employed. For example, the first end portion 91 may include a hole 94 for receiving and retaining a pin 95 extending from the second end portion. Preferably, the second end portion 92 also includes a hole 97 for receiving a second pin 99 extending from the first end portion 91. Most preferably, the second end portion 92 includes a flexible surface 98 having a button 100 disposed thereon. Flexibility may be enhanced by providing slots 99 in the end portion 98. As shown in FIG. 2A, the button 100 is received by an aperture 101 in the shaft 11 of the mop, whereby the shaft connector 74 is retained preventing axial or rotational movement within the shaft 11. To release the shaft connector 74 from the shaft 11, a user depresses the button 100 and separates the shaft connector 74 from the shaft 11. The shaft connector 74 preferably includes a flange portion 103 that prevents the operating member 20 from passing beyond the mop element end 14 of the mop 10.

As shown in FIGS. 2A and 10, the twist mop 10 preferably includes a binder 102 retaining together portions 104, 105 of the mop element 17, thus forming a tuft 107 at the mop element end 14 of the twist mop 10. The tuft 107 may be employed, for example, when the operating member is in the latch position in cleaning a narrow space or a high surface. In addition, the tuft 107 impedes the shaft connector 74 from contacting, and thus possibly scratching or damaging, a mopped surface.

With reference to FIGS. 7, 8, 10, and 13, the operating member connector 73 comprises a unitary body having an interior cylindrical portion 109 sized to fit within the operating member 20 and an exterior bell portion 110 that extends beyond the operating member 20 when the connector 73 is assembled with the operating member 20. The operating member connector 73 further includes means for securing the mop element 17 to the bell portion 110, which means preferably comprises the tie 85. (See FIG. 12). The mop element end 111 of the operating member connector 73 is flared to retain the tie 85.

Figure 13:
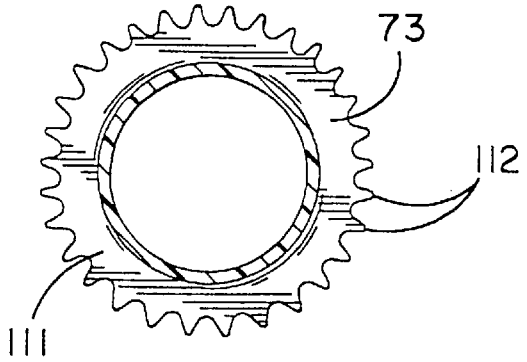
FIG. 13 is a cross-sectional view of the operating member connector taken along lines 13—13 of FIG. 7.

Friction between the tie 85 and operating member connector 73 will impede relative rotation of the mop element 17 and connector 73. Preferably, the operating member connector 73 further includes additional means for restraining relative rotation of the mop element with respect to the operating member. For example, as illustrated in FIG. 13, the operating member connector may include a plurality of notches 112 that are disposed on the exterior portion 110 and that extend radially away from the shaft 11 of the mop 10. At least some of the ropes are retained by the notches 112, whereby the ropes, and hence the mop element 17, are restricted from rotating with respect to the operating member.

In accordance with a preferred embodiment of the invention, a surface 114 of the operating member connector 73 is flexible, and includes a button 115. The operating member 20 includes an aperture 116 (best shown in FIGS. 1 and 2) for receiving the button 115 when the connector 73 is assembled with the operating member 20, and for retaining the connector 73 from axial or rotational movement within the operating member 20. To release the operating member from the connector, a user depresses the button 115 and separates the operating member connector 73 from the operating member 20. The shaft connector should first be removed from the shaft, and the operating member then moved far enough towards the mop element end 14 of the shaft 11 such that clearance of the shaft 11 beneath the button 115 is provided.

Figure 11:
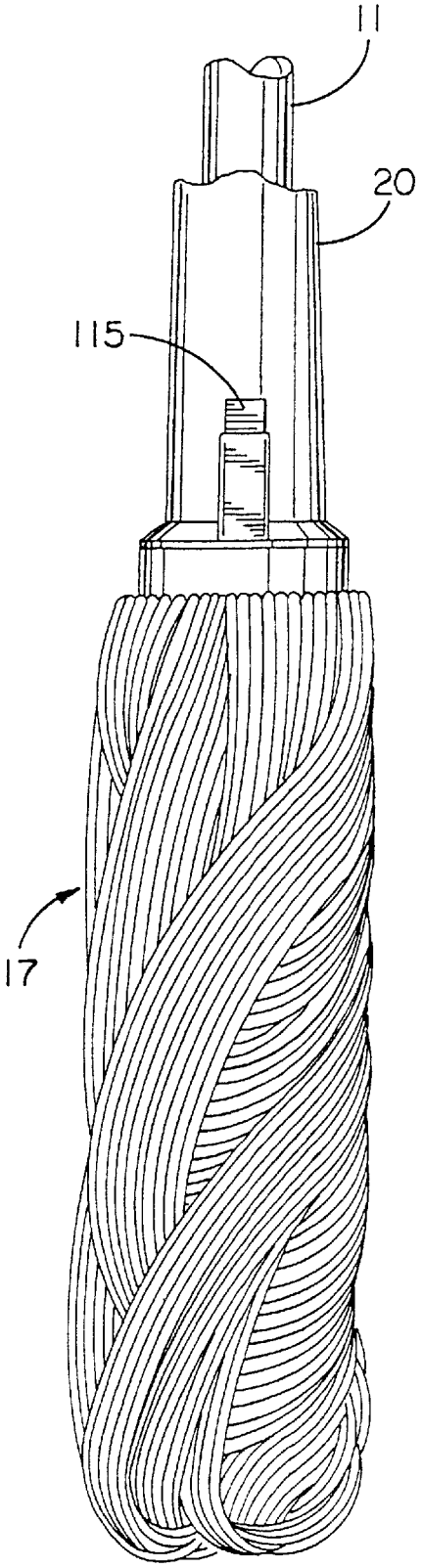
FIG. 11 is elevational view of the mop as shown in FIG. 2, illustrating the mop element in a twisted condition.

In use, the operating member 20 may be placed in a mopping position, as shown, for example, in FIG. 1. When it is desired to wring liquid from the mop element 17, the operating member is moved to the latch position, where it is retained by the latch mechanism. The operating member 20 is then rotated with respect to the shaft 11. A twist will thereby be imparted to the mop element 17, as shown in FIG. 11, thus causing liquid to be expelled from the mop element and may be advanced in increments. The operating member 20 need not be advanced through a large angle of rotation to effect wringing of the mop element. After wringing, the latch mechanism is released by squeezing together the tabs 34, 35. Torsional forces generated within the mop element will cause the mop element to return to an untwisted position with respect to the shaft, and the operating member will return to a mopping position. Either untwisting or return to a mopping position may be assisted manually.

Alternatively, the mop 10 may be used when the operating member 20 is in the latch position, as shown in FIG. 2. For example, when in this position, the mop 10 may be used for mopping or dusting in narrow or high places. The tuft 107 prevents any portion of the twist mop 10 other than the mop element 17 from contacting the mopped surface. Preferably, the twist mop 10 is stored when the operating member 20 is in the latch position.

Thus, it is seen that the foregoing general object has been satisfied. A twist mop prepared in accordance with the invention may be easily wrung by an operator, and need not be rotated through a large angle of rotation. Moreover, the rotation of the operating member may be advanced in small angular increments, and the ratchet device and latch will prevent the operating member from rotating in a direction opposite the desired direction of rotation or in slipping to an operating position and relieve the wringing forces. Thus, the exertion of a great amount of strength is not required to wring the mop. In addition, the ropes of the mop element may be prepared in sufficient length to provide a satisfactory mop element area.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references and previous applications cited herein are hereby incorporated by reference in their entireties.

What is claimed is:

1. A mop comprising:

an elongate shaft having an operator end and a mop element end;

an operating member mounted in an axially moveable relationship to said shaft between a latch position and a range of mopping positions;

a mop element of liquid absorbent material mounted to the operating member and the mop element end of the shaft and extending therebetween;

a housing supported by the shaft;

a latch mechanism including a shoulder portion and a detent portion, one of the portions being supported on the shaft between the ends and the other being supported on the operating member, the detent portion being supported in said housing, the detent portion comprising a pair of caliper jaws, said caliper jaws being pivotally movable with respect to said housing and pivotable about a pivot rod, and further including a ratchet device having a ratchet wheel portion supported on the operating member and a pawl portion being supported on the shaft;

wherein the operator member is restrained in the latch position when the shoulder portion and the detent portion are in an operative relationship, the operating member is relatively rotatable with respect to the shaft, and the ratchet device releasably restricts relative rotation of the shaft and the operating member to one direction.

2. The mop of claim 1 wherein the pivot rod is secured to the housing, a portion of the rod extending into a blind hole in said housing.

3. The mop of claim 1 wherein an end portion of each jaw forms a tab to enable manual pivoting of said jaw about said pivot rod.

4. The mop of claim 3 wherein the pawl portion includes a plurality of pawl teeth.

5. The mop of claim 3 the ratchet wheel portion includes a ratchet surface having a plurality of ratchet teeth and the pawl portion includes a pawl surface having a plurality of pawl teeth, said ratchet teeth can be interdigitally engaged with said pawl teeth when said ratchet wheel and pawl are engaged.

6. The mop of claim 5 wherein the ratchet surface and the pawl surface are generally parallel to the shaft.

* * * * *